US007168366B2

(12) United States Patent
Louviere et al.

(10) Patent No.: US 7,168,366 B2
(45) **Date of Patent: *Jan. 30, 2007**

(54) APPARATUS AND METHOD FOR IMPRINTING A VIAL

(76) Inventors: Kent A. Louviere, 314 School Board Dr., New Iberia, LA (US) 70560; A. Robert Coningsby, III, 3000 NE. 12th Ter., Ft. Lauderdale, FL (US) 33334

( * ) Notice: Subject to any disclaimer, the term of this patent is extended or adjusted under 35 U.S.C. 154(b) by 0 days.

This patent is subject to a terminal disclaimer.

(21) Appl. No.: 11/155,101

(22) Filed: Jun. 17, 2005

(65) Prior Publication Data

US 2005/0284313 A1 Dec. 29, 2005

Related U.S. Application Data

(63) Continuation-in-part of application No. 10/963,614, filed on Oct. 13, 2004, which is a continuation-in-part of application No. 10/799,968, filed on Mar. 10, 2004, now Pat. No. 7,007,445, which is a continuation of application No. 09/594,528, filed on Jun. 14, 2000, now Pat. No. 6,735,926, which is a continuation-in-part of application No. 09/054,905, filed on Apr. 3, 1998, now Pat. No. 6,101,791.

(51) Int. Cl.
*B41F 17/00* (2006.01)

(52) U.S. Cl. ..... 101/35; 198/608; 198/370.11; 604/411

(58) Field of Classification Search ..... 198/608, 198/370.11; 101/35; 604/411
See application file for complete search history.

(56) References Cited

U.S. PATENT DOCUMENTS 3,613,571 A * 10/1971 Russell et al. ..... 101/40
4,050,412 A * 9/1977 Bautz ..... 118/642
4,109,446 A * 8/1978 Krohn et al. ..... 53/282
4,235,579 A 11/1980 Kurz et al.
4,588,391 A * 5/1986 Evans et al. ..... 493/165
4,672,892 A * 6/1987 Ackley ..... 101/35
4,840,691 A 6/1989 Knape
5,570,632 A * 11/1996 Cumens et al. ..... 101/35
5,836,618 A 11/1998 Perlman
5,985,376 A 11/1999 Kamen
6,062,287 A * 5/2000 Ernest ..... 156/542
6,086,061 A * 7/2000 Vedoy et al. ..... 271/3.01
RE37,248 E 6/2001 Dudley
6,584,894 B1 * 7/2003 Mason ..... 101/35

(Continued)

*Primary Examiner*—Ren Yan
*Assistant Examiner*—Matthew Marini
(74) *Attorney, Agent, or Firm*—C. Dean Domingue; Robert L. Waddell; Ted M. Anthony

(57) ABSTRACT

An apparatus and method for printing onto vials. The vials may be connected in a series, the vials having an open end and a closed end. The apparatus comprises a conveyor for moving the vials, the conveyor having a mandrel for receiving the open end of the vials. The mandrel may contain a plurality of receiving post, for capturing the vials. The apparatus may further include a vial depressor for depressing the vials onto the receiving post of the mandrel, a first offset inking transfer device for printing a first ink pattern onto the vials, and a first ultra violet dryer positioned to receive the vials from the first offset inking transfer device and provide for curing of the ink pattern from the first offset inking transfer device.

32 Claims, 10 Drawing Sheets

U.S. PATENT DOCUMENTS 6,634,291 B2 10/2003 Huang
6,732,642 B1 5/2004 Huang
6,739,249 B1 5/2004 Huang
2003/0041754 A1 3/2003 Huang

* cited by examiner

APPARATUS AND METHOD FOR IMPRINTING A VIAL

This application is a continuation-in-part of my patent application bearing Ser. No. 10/963,614 filed on 13 Oct. 2004, which is a continuation-in-part application of my patent application bearing Ser. No. 10/799,968 filed on 10 Mar. 2004 now U.S. Pat. No. 7,007,445, which is a continuation application from my patent application bearing Ser. No. 09/594,528 filed on 14 Jun. 2000, now U.S. Pat. No. 6,735,926, which is a continuation-in-part application of my application bearing Ser. No. 09/054,905 filed on 3 Apr. 1998, now U.S. Pat. No. 6,101,791.

BACKGROUND OF THE INVENTION

This invention relates to an apparatus and method for imprinting a vial. More particularly, but not by way of limitation, this invention relates to an offset printing system and method for printing onto a vial.

A method of producing a series of interconnected vials was disclosed in my co-pending continuation-in-part patent application bearing Ser. No. 10/799,968, filed on 10 Mar. 2004 which is incorporated herein by reference. The vials produced by the method and apparatus are interconnected. The vials can be filled with a material. In one preferred embodiment, the vials can be filled with a medicine. The vials can then be heat sealed so that the material is held within a self-contained unit.

Users of the vials will require information of the type of material contained within the container. In the situations wherein the vials contain medicine, certain information such as type of medicine, dosage amount, manufacturer, expiration date, etc. is very important. Additionally, the number of vials filled and the lot from which material originated is also very important. Prior art techniques include printing onto a label, and then placing the label onto the vial. However, this is undesirable for several reasons. First, the placement of the labels onto the vials is a highly inefficient and time consuming process. Additionally, the type of ink and/or glue used must not be toxic or environmentally unsafe since the ink and/or glue has a possibility of contaminating the material contained within the vial, or alternatively, the ink making the outer portion of the vial unsanitary.

Hence, there is a need for an apparatus to imprint onto a container. There is a further need to imprint onto a series of interconnected vials. Still further, there is a need to imprint a label that is safe to the user and the environment. There is also a need to print onto a plastic article that is irregular in size and shape. These and many other needs will be met by the following invention.

SUMMARY OF THE INVENTION

In a first embodiment, which is a preferred embodiment of this application, an apparatus for imprinting vials is disclosed, and wherein the vials are connected in a series. The apparatus comprises a hopper for holding the vials and for positioning the vials onto a track. The apparatus further comprises a conveyor for moving the vials, with the conveyor having a mandrel for receiving an open end of the vials. The mandrel contains a plurality of receiving post for receiving the vials, and wherein a base portion of the receiving post has a greater cross-sectional area than a head portion of the receiving post.

The apparatus further comprises a vial depressor for depressing the vial onto the receiving post of the mandrel. A first offset inking transfer device for printing a first ink pattern onto the vials is included along with a first ultra violet dryer positioned to receive the vials from the first offset inking transfer device and provide for curing of the ink pattern from the first offset inking transfer device.

In one embodiment, the vial depressor comprises a first wheel and a second wheel, and wherein the top of the vials will abut a space created between the first wheel and the second wheel. The apparatus may further comprise an air cooler device for cooling the air and directing the cool air onto the vials in order to cool the vials. The apparatus also comprises a vial remover comprising a plate positioned on the underside of the conveyor and down stream of the first ultra violet dryer so that the vials are removed from the mandrel. The apparatus may also include a photo-eye device, positioned downstream of the vial depressor, for determining whether the vials are positioned on the mandrel and transmitting a signal in order to halt the conveyor if the vials are improperly positioned on the mandrel.

In one preferred embodiment, a laser engraver is included in order to engrave an alpha numeric number onto the vial. Also, a flame treater means, positioned downstream of the vial depressor, is included so that the vials are heat treated in preparation of the printing of the ink pattern on the vials.

In the preferred embodiment, a second offset inking transfer device for printing a second ink pattern onto the vials is included along with a second ultra violet dryer positioned to receive the vials and provide for curing of the ink pattern from the second offset ink transfer device.

A method of imprinting a series of interconnected vials is also disclosed. In the most preferred embodiment, the method comprises providing the series of interconnected vials onto a track, and placing the vials onto a mandrel having a plurality of receiving post, for receiving the vials. The receiving post have a base portion that has a greater cross-sectional area than a head portion of the receiving post.

The method further includes depressing the vials onto the mandrel with a vial depressor for depressing the vial onto the receiving post of the mandrel. Next, the vials are imprinted with a first offset inking transfer device, and the ink is cured with a first ultra violet dryer. The method further includes printing onto the vials with a second offset inking transfer device, curing the ink with a second dryer, and removing the vials with a vial remover. In one preferred embodiment, the vial remover comprises a plate positioned on the underside of the conveyor and down stream of the first dryer so that the vials are removed from the mandrel. The method may further include cooling the vials.

In one preferred embodiment, the vial depressor comprises a first wheel and a second wheel, and wherein the top of the vials will abut a space created between the first wheel and the second wheel, and the step of depressing the vials includes abutting the first and the second wheel against a top portion of the vials so that the vials are captured on the mandrels.

In a second preferred embodiment, which is the most preferred embodiment of this application, an apparatus for printing onto plastic containers is disclosed. The apparatus of this second embodiment comprises a conveyor means for moving the containers. The apparatus includes a mandrel, operatively associated with the conveyor means, for receiving the containers. The apparatus further includes a first offset inking transfer device for printing a first ink pattern onto the containers and a first ultra violet dryer positioned to receive the containers from the first offset inking transfer device and provide for drying of the ink pattern from the first offset inking transfer device. The apparatus may further comprise a second offset inking transfer device for printing a second ink pattern onto the containers, and a second ultra violet dryer positioned to receive the containers and provide for drying of the ink pattern from the second offset ink transfer device. An in-line feed assembly for delivering the series of containers to the mandrel may also be included. The in-line feed assembly contains an air jet means for advancing the series of containers, and a realignment means, receiving the containers from the air jet means, for delivering the containers to a belt transporter. The realignment means may comprise a photo-eye sensor for determining if the containers are positioned on a first track, and a piston for pushing the series of containers onto a second track. The in-line feed assembly may further include a belt transporter, and wherein the belt transporter comprises a plurality of gears, a belt disposed around the gears, and notches formed on the belt that engage the containers, and delivers the containers to the mandrel.

In this second preferred embodiment, a method of imprinting plastic containers is also disclosed. The method includes providing the series of plastic containers onto a track, placing the containers on a mandrel, and capturing the containers on the mandrel. The method further includes printing onto the containers with a first offset inking transfer device, and curing the ink with a first ultra violet dryer. This method may further include printing onto the vials with a second offset inking transfer device, curing the ink with a second ultra violet dryer, and removing the containers from the mandrel.

An advantage of the present invention includes use of an offset inking transfer device which is a fast and efficient technique for printing onto plastic vials. Another advantage is that the process herein described allows for mass labeling production i.e. quickly imprinting text and numeric information in significant production quantities. Another advantage is the apparatus and method can be used as a means for printing identifying information onto a container, without the use of prior art paper labels and/or glue.

Yet another advantage is that the imprinted vials are treated with an ultra violet dryer so that toxins are eliminated from the surface of the vials as well as to the internal portion of the vial. This is possible according to the present invention since the ink is cured and solidified before any ink can permeate through the walls and into the inner portion of the vial. Another advantage is that the imprinted vials can be used for medical purposes. For instance, a liquid medicine can be placed within the vials, and the vials can be sealed. Then, the user can twist the top of the vial and open the vial. This can all be done since the ink of the printed material has been properly cured. Another advantage is that the ultra violet dryers make the ink impermeable in the plastic which is an important health and safety issue.

A feature of the invention is that a conveyor means is used to transport the vials for printing and treating. Another feature is that a specially designed mandrel carries the vials on the conveyor belt. Still another feature is the design of the mandrel in conjunction with the vial depressor captures the vial on the mandrel for printing. Another feature is that the physical dimensions of the mandrel, which includes the size, shape and spacing of the receiver post, can be easily changed in order to accommodate various size vials without having to retool the entire assembly line and components.

Yet another feature is the ultra violet light that cures the ink after printing. Another feature is the laser engraver that engraves the vials with various pertinent information. Another feature is the use of an air cooler for cooling the vials after the printing. Still yet another feature is that in the preferred embodiment, multiple printing stations are provided. Yet another feature is the flame treater prepares the plastic for imprinting. Still yet another feature is the use of multiple photo-eye sensors confirms the proper placement of the vials within the system, and aids and synchronizes the process.

DETAILED DESCRIPTION OF THE PREFERRED EMBODIMENTS

Figure 1:
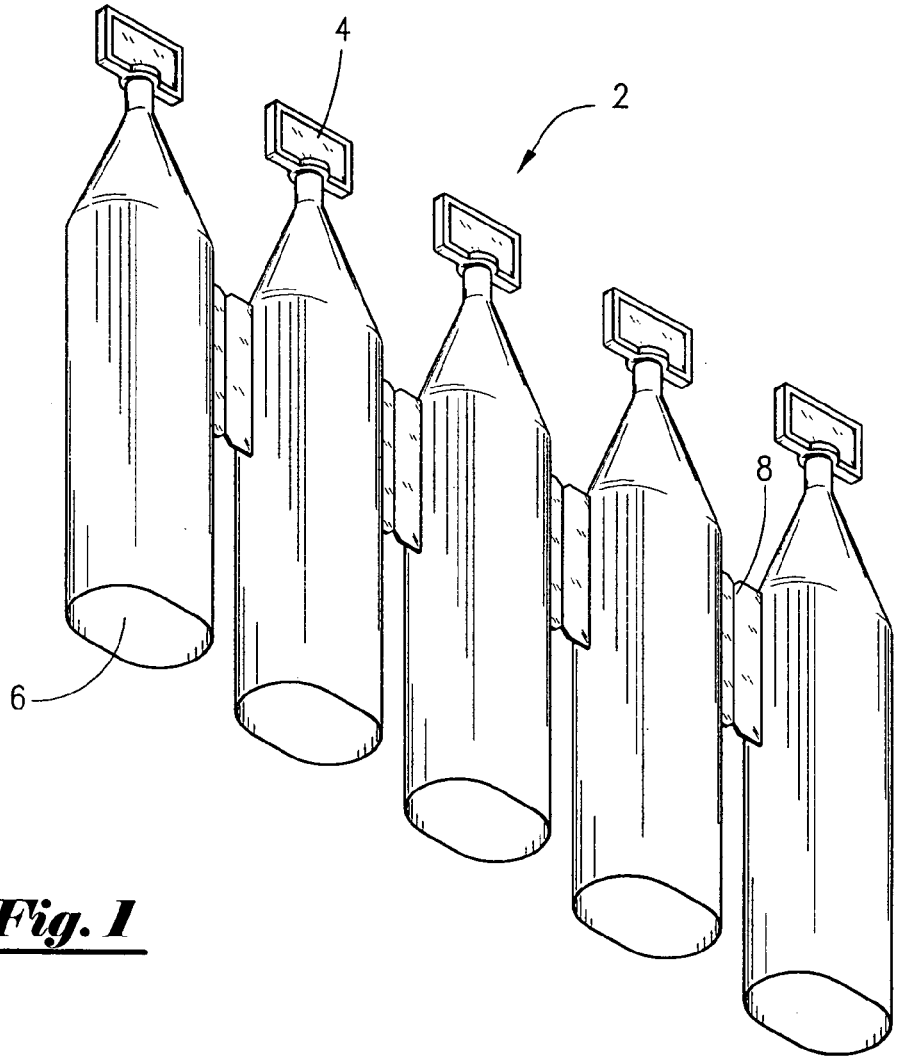
FIG. 1 is an isometric view of the preferred embodiment of the vial string of the present invention.

Referring now to FIG. 1, an isometric view of a preferred embodiment of the vial string 2 of the present invention will now be described. This application is a continuation-in-part of my co-pending patent application bearing Ser. No. 10/963,614 filed on 13 Oct. 2004 which is a continuation-in-part application of my patent application bearing Ser. No. 10/799,968 filed on 10 Mar. 2004, which is a continuation application from my patent application bearing Ser. No. 09/594,528 filed on 14 Jun. 2000, now U.S. Pat. No. 6,735,926, which is a continuation-in-part application of my application bearing Ser. No. 09/954,905 filed on 3 Apr. 1998, now U.S. Pat. No. 6,101,791, and wherein the co-pending application Ser. No. 10/799,968 is incorporated herein by express reference. Additionally, U.S. Design Patent D460, 175 is also incorporated herein by express reference. As per the teachings of these references, the vial string 2 is produced, and wherein the vial string 2, in one preferred embodiment, contains a string of five (5) interconnected vials. The vial string 2 will also be referred to as the string of vials 2, or a row of vials 2.

The vials have a closed top portion 4 and an open bottom portion 6. After production of the vial string 2, the bottom portion 6 is generally an oblong shaped opening, and as per the teachings of this invention, the bottom portion can be filled with a material, such as a medicine, and thereafter, the bottom portion 6 can be heat sealed to form a closed container. In order to use the material, such as liquid medicine within the vial, the user would simply twist the top portion 4 thereby opening the vial to the contents therein.

FIG. 1 shows five (5) vials interconnected. It should be understood that in the most preferred embodiment, the invention is applicable to individual vials connected in series. The series may contain over a dozen interconnected vials. The vials are interconnected via the interconnecting arms 8. The vials are constructed of a plastic, and in one preferred embodiment, the plastic can be purchased from Dow Chemical Company under the trade name Metallocene Resin PT 1450. In a second embodiment, the invention is applicable to other types of vials, such as plastic containers. The plastic containers may be manufactured using known prior art techniques such as blow molding as well as the techniques previously discussed. With the teachings of this invention, unit dosage types of containers can have imprinted images, patterns and/or alpha numeric text that will not contaminate or compromise the integrity or safety of the material that is held within the container.

Figure 2:
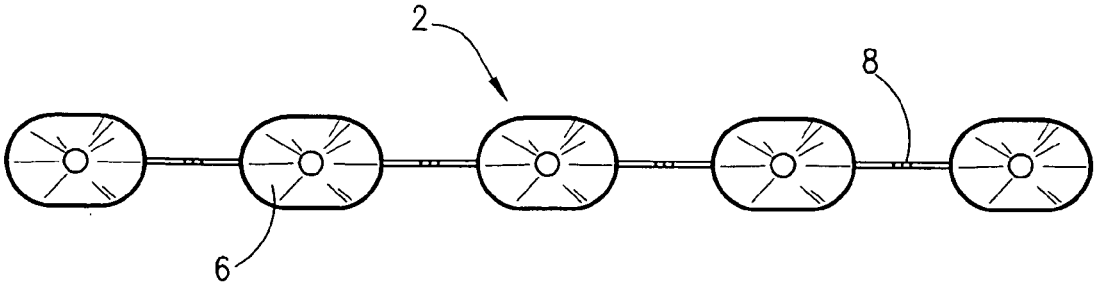
FIG. 2 is a bottom view of the vial string seen in FIG. 1.

Referring now to FIG. 2, a bottom view of the vial string 2 seen in FIG. 1 will now be described. The view of FIG. 2 depicts the oblong shape opening of the bottom portion 6. It should be noted that the invention herein described is also applicable to vials that have other shaped openings; however, the shape of the body of the vial will need to be matched by the body of the mandrel and the attached receiver post, as will be more fully explained later in the application.

Figure 3:
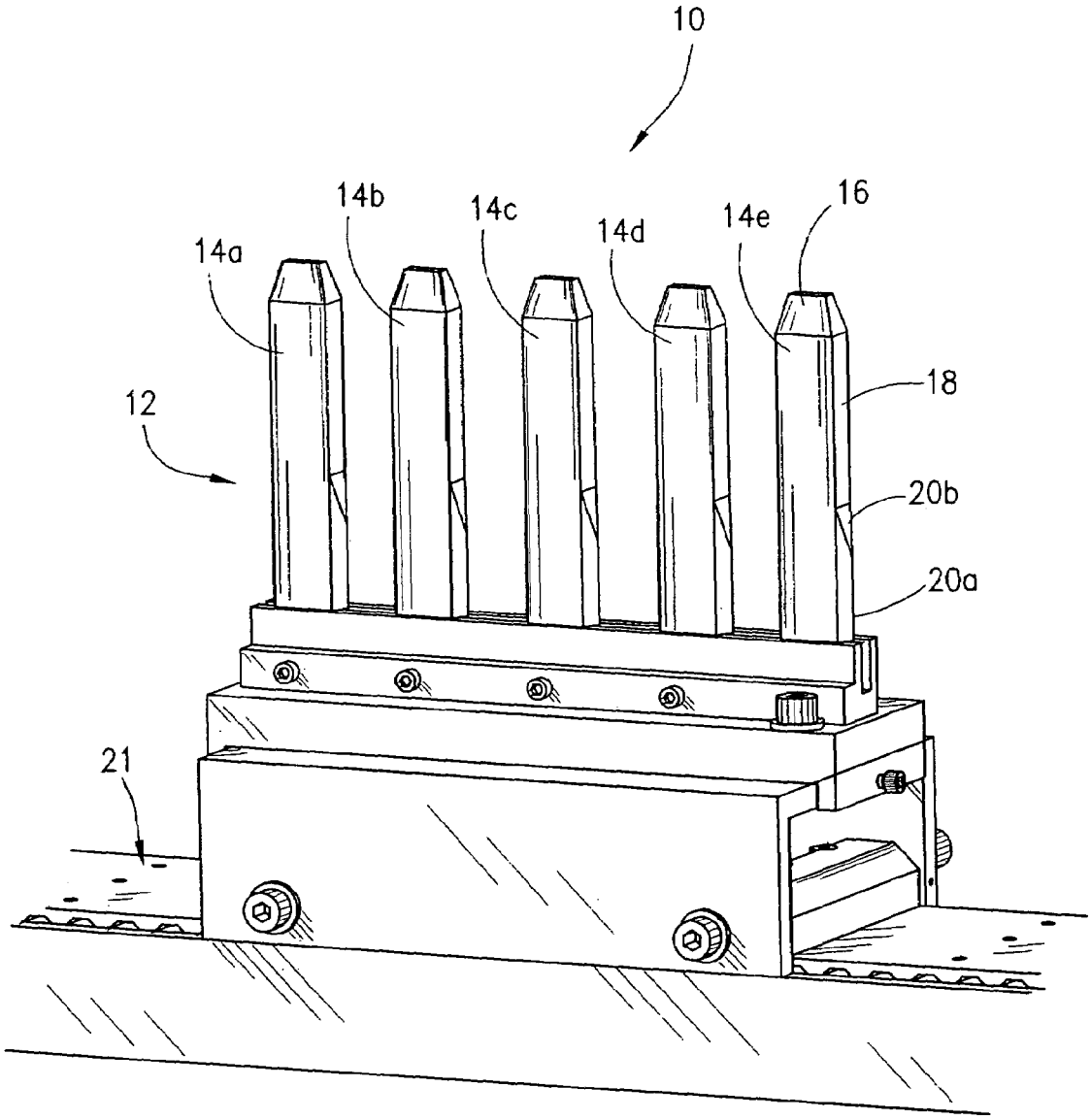
FIG. 3 is an isometric view of the preferred embodiment of the mandrel with receiver post used in this invention.

Thus, in FIG. 3, which is an isometric view of a preferred embodiment of the mandrel 10, the plurality of receiver posts, seen generally at 12, will be configured so that the vial string 2 fits thereon. More specifically, and as seen in FIG. 3, the mandrel 10 consists of a plurality of individual receiver post 14*a*, 14*b*, 14*c*, 14*d*, 14*e*. The receiver post have a pointy top portion 16 that extends to an elongated body 18 which in turn extends to an expanded bottom portion 20*a* (sometimes referred to as the bottom flare 20*a*). More specifically, the expanded bottom portion 20*a* has a first side 20*b* and a second side (not shown in this view), and wherein the cross-sectional area of the first side and the second side is triangular. The expanded bottom portion 20*a* is generally in the shape of the bottom portion 6 of the vial, which in the preferred embodiment will be an oblong shape seen in FIG. 2. Returning to FIG. 3, once the string of vials 2 are placed onto the mandrel 10, the inner part of the bottom portion 6 of the vials will abut the outer part of the expanded bottom portion 20*a* of the receiver post, as will be further described later in the application. Due to the bottom flare 20*a*, the cross-sectional area of the bottom portion of the receiver post is greater than the cross-sectional area of the top part of the receiver post. The individual receiver post 14*a*, 14*b*, 14*d*, 14*e* are attached to the bottom part of the mandrel 10, and wherein the bottom part of the mandrel is attached to the conveyor belt 21, as will also be described in greater detail.

Figure 4:
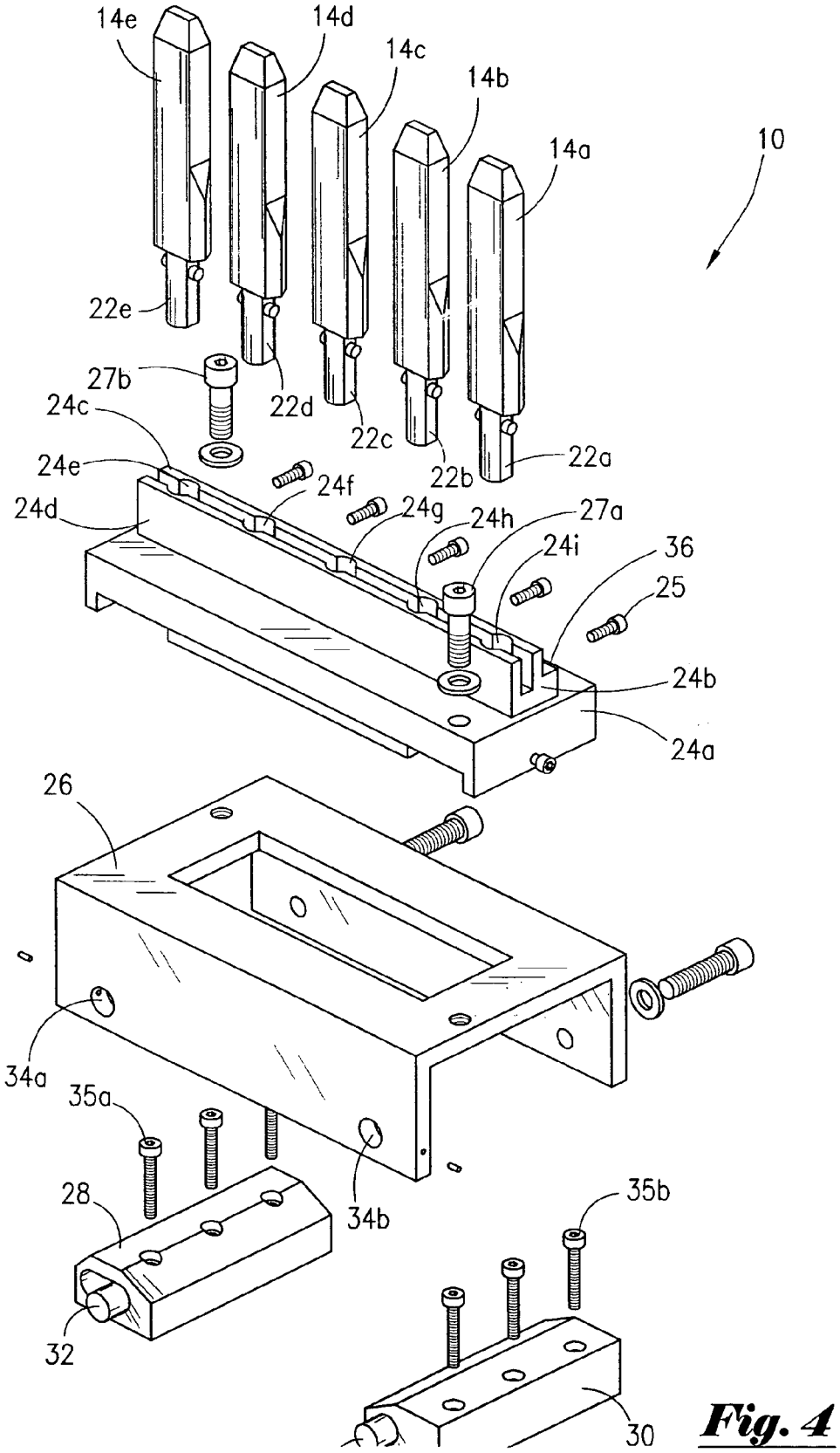
FIG. 4 is an exploded view of the mandrel and receiver post seen in FIG. 3.

FIG. 4 is an exploded view of the components of the mandrel 10, including the receiver post 14*a*, 14*b*, 14*c*, 14*d*, and 14*e* seen in FIG. 3. As shown in FIG. 4, the receiver post 14*a*–14*e* contain a leg extensions 22*a*, 22*b*, 22*c*, 22*d*, 22*e*, and wherein the mandrel 10 contains a fastener sleeve 24*a* and the attached rim 24*b*. The rim 24*b* includes a first side 24*c* and a second side 24*d*. As seen in FIG. 4, the leg extensions 22*a*–22*e* will fit into the rim 24*b* of fastener sleeve 24 via openings 24*e*, 24*f*, 24*g*, 24*h*, 24*i*, and wherein the leg extensions will be attached to the rim 24*b* of fastener sleeve 24*a* via fastener means such as nuts and bolts (ergo bolt 25). The rim 24*b* is fixedly attached to the fastener sleeve via conventional means such as nuts and bolts. The fastener sleeve 24 will in turn be attached to a shell 26 via conventional means, such as nuts and bolts 27*a*, 27*b* and the shell 26 will in turn be attached to the drive blocks 28, 30. The drive blocks 28, 30 will have the pallet shafts 32, 33 disposed there through, and wherein the blocks 28, 30 will be attached to the conveyor belt via conventional means such as bolts 35*a*, 35*b* so that the mandrel 10 can be transported on the conveyor belt. The pallet shafts 32, 33 will be disposed within the openings, such as openings 34*a*, 34*b* in shell 26. The rim 24*b* contains the shoulder 36 contained on first side 24*c* that will cooperate with a vial removal plate that will be discussed later in the application.

Figure 5A:
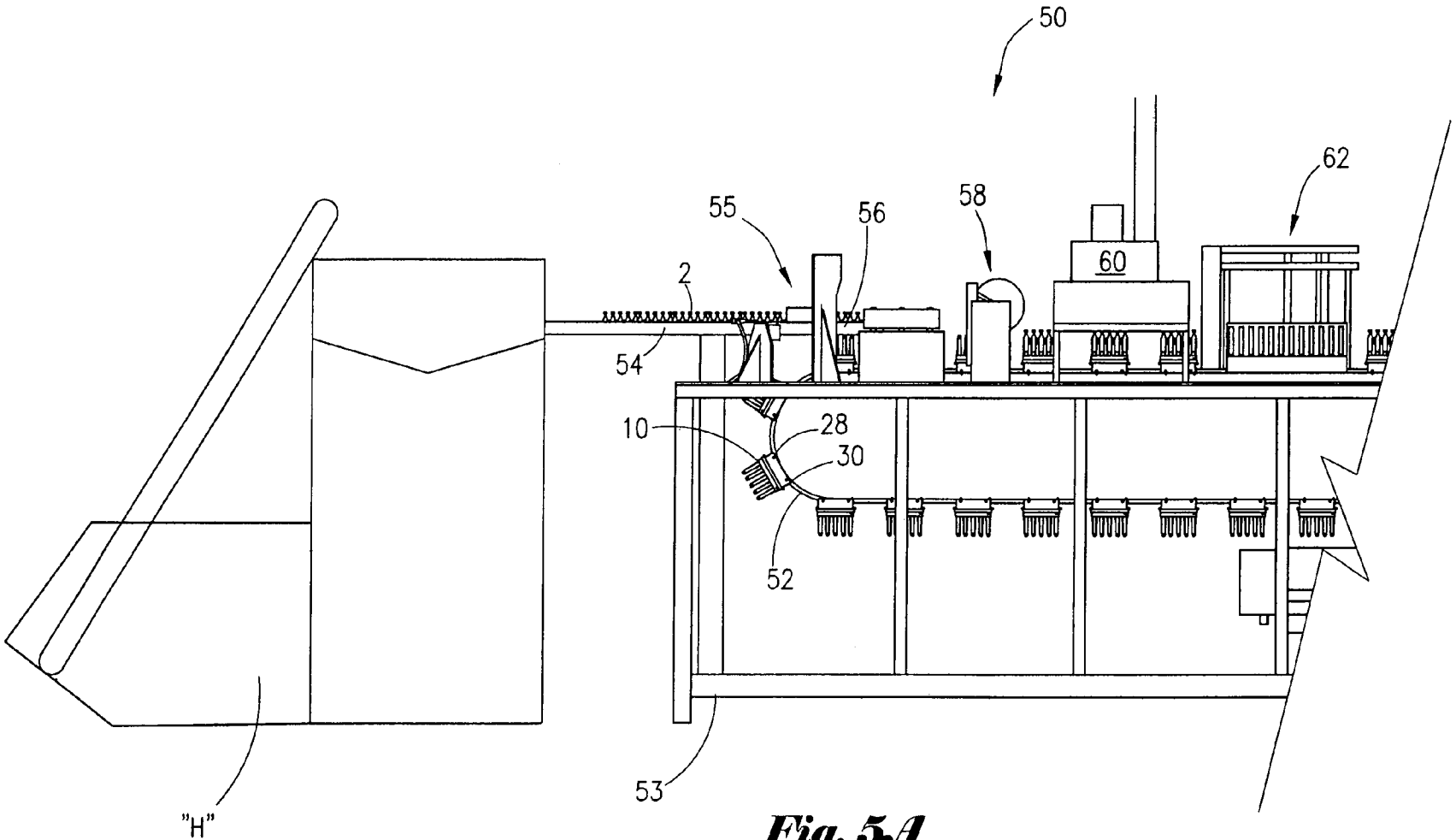
FIGS. 5A and 5B are perspective views of the most preferred embodiment of the printing system herein disclosed.
Figure 5B:
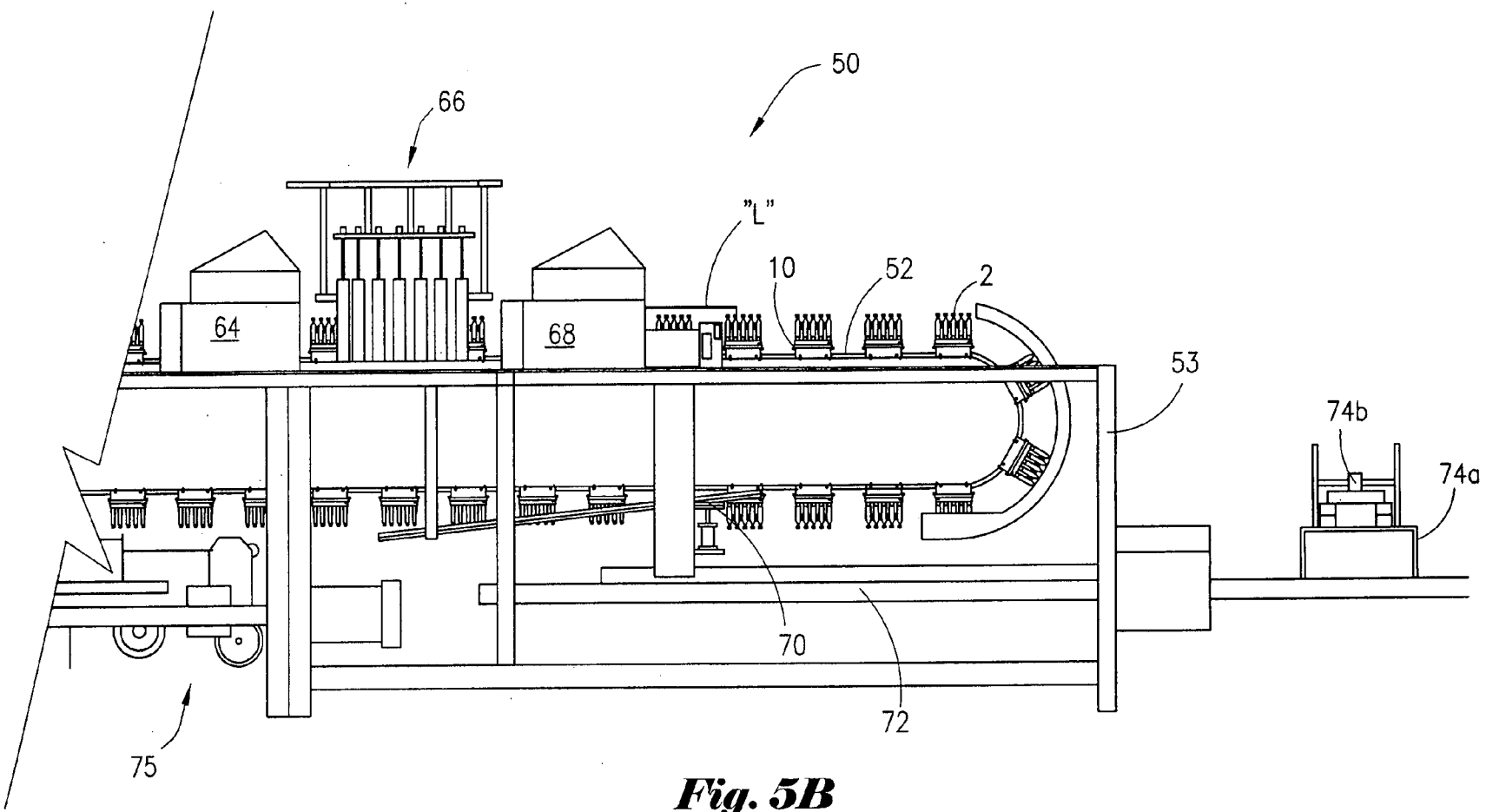

Referring now to FIG. 5A and FIG. 5B, a perspective view of the most preferred embodiment of the printing system 50 will now be described. The system 50 includes the conveyor belt 52, and wherein a plurality of mandrels are operatively attached to the conveyor belt via drive blocks, such as drive blocks 28, 30. Mandrel 10 is shown attached on the conveyor belt 52. In the most preferred embodiment, approximately fifty (50) mandrels are attached to the conveyor belt 52. The conveyor belt 52 is mounted on a support table 53.

As noted earlier, in the most preferred embodiment, a string of vials consist of five (5) interconnected vials. An array of vial strings refers to several lined-up string of vials. An array of vial strings will be fed from a hopper "H" to the first track 54, then to in-line feed assembly mechanism 55, and wherein the in-line feed assembly 55 feeds and aligns a string of vials from first track 54 to a second track 56 and in turn to an awaiting mandrel. The in-line feed assembly 55 will be described in greater detail later in the application.

From the second track 56, the vial strings will be dropped onto the mandrels. A vial depressor 58 will act to depress and capture the vial string onto the mandrel. The vial depressor 58 contains a wheel means that automatically lowers onto the top of the vial string thereby lowering and capturing the vial string onto the mandrel. After the string of vials are placed onto the mandrel, the conveyor belt 52 will transport the vial string to a flame treater means 60 for heating the surface of the vials in preparation for the offset printing process as well as burning contaminants. A flame treater means 60 is commercially available from Arco Gas Inc. under the name Flame Treater FTS 102DR.

After the string of vials has been heat treated, the conveyor belt 52 will transport the vial string to the first offset inking transfer device 62 (sometimes referred to as the pad printing offset transfer station 62), wherein the offset inking transfer device 62 is commercially available from Apex Machine Company under the name Model S40. The first printing station 62 may print a base coat and other preliminary images and/or patterns.

As seen in FIG. 5B, the conveyor belt 52 will then transport the vial string to the ultra violet dryer means 64 for curing of the ink pattern from the first printing station 62. The ultra violet dryer means 64 is commercially available from Aetek UV Systems Inc. under the model number XL062034.

The conveyor belt 52 will then transport the vial string to the second offset inking transfer device 66 (sometimes referred to as the second pad printing offset transfer station 66), wherein the offset inking transfer device 66 is commercially available from Apex Machine Company under the name Model S40. The second printing station 66 may print a pattern and alphanumeric information beneficial to end users of the vials. Next, the conveyor belt 52 will transport the vial string to the ultra violet dryer means 68 for curing of the ink pattern from the second printing station 66. The ultra violet dryer means 64, 68 are commercially available from Aetek UV Systems Inc., as noted earlier. Also housed next to the dryer means 68 is the laser engraver means L for engraving with a laser information, wherein the laser engraver means L is commercially available from Laser Link Corp. under the name Smart Lase 130X.

As seen in FIG. 5B, the conveyor belt 52 will then loop around on the underside of the support table 53. A means for removing the vials from the mandrels is provided. More specifically, once the conveyor belt 52 loops onto the under side of support table 53, a removal plate 70 is provided, and wherein the removal plate 70 travels longitudinally upward and downward, engaging with the mandrels, and stripping the string of vials from the mandrel. Therefore, as the conveyor belt 52 continues its loop about the table 53, the oscillating plate 70 will act to remove the vial string from the mandrel. The vial strings will then fall onto the transporter 72, and wherein the transporter 72 is also a conveyor belt assembly which transports the printed string of vials. An air cooler device 74*a* is operatively associated with the transporter 72, and wherein the air cooler device cools the air and directs the cool air onto the vials. In the most preferred embodiment, the air cooler device consist of a container having four (4) air fans, such as fan 74*b*, that suction ambient temperature air into the inside of the container. In this way, the plastic vials are cooled, thereby preventing sticking of the vial string together which could result in harming the vials, or disrupting the packaging process. Motor means 75 for providing a motive force to energize and move the conveyor means is also shown.

Figure 6:
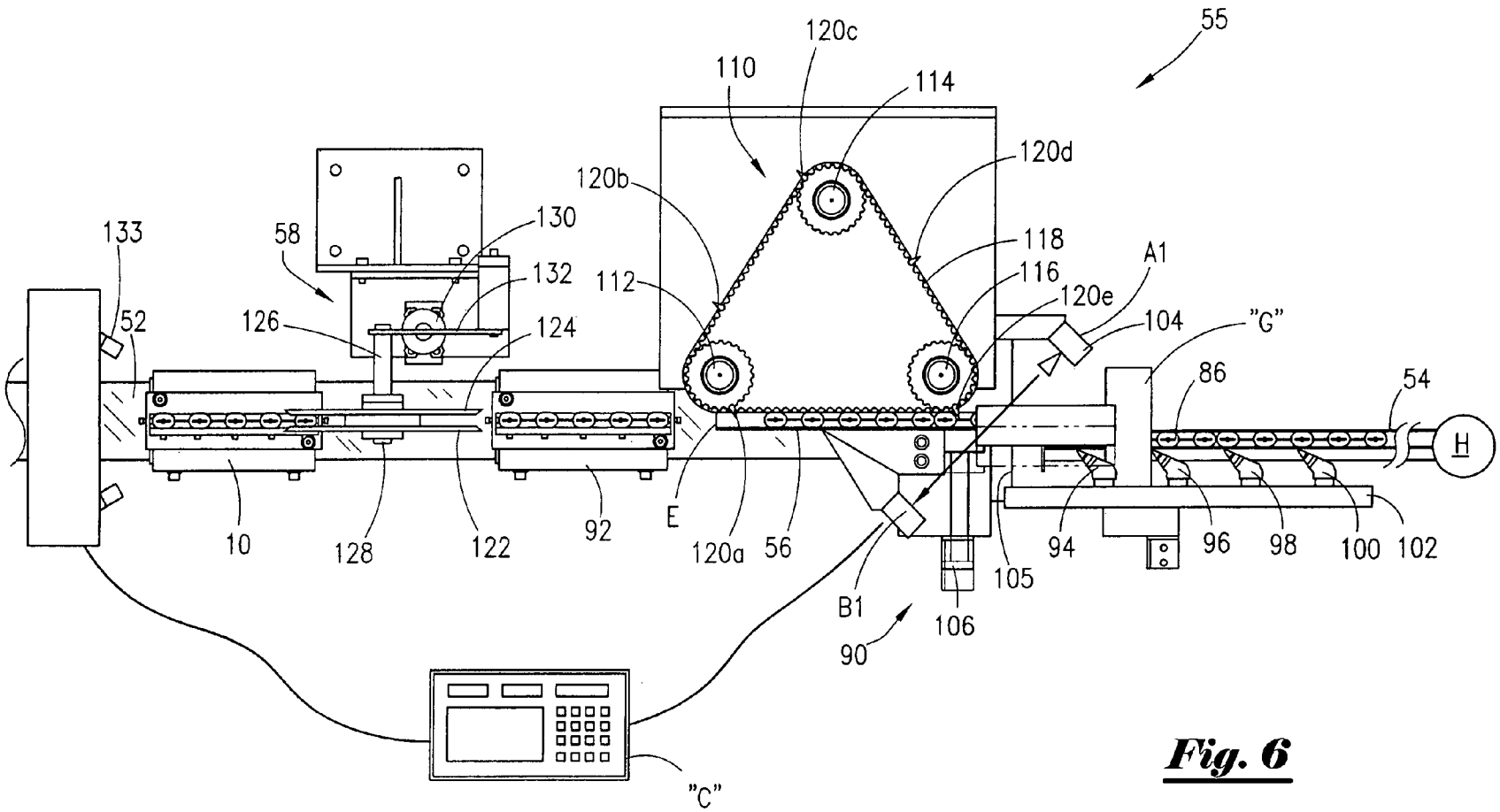
FIG. 6 is a top view of the preferred embodiment of the in-line feed assembly and the vial depressor used in this invention.

Referring now to FIG. 6, a top view of the preferred embodiment of the in-line feed assembly 55 and the vial depressor 58 will now be described. The in-line feed assembly 55 is associated with the first track 54 that will contain the array of vial strings, seen generally at 86. The array of vial strings 86 consist of several lined up string of vials, and wherein an individual string of vials comprises five (5) interconnected vials, as noted earlier. The hopper "H" will deliver the string of vials onto the first track 54 so that the string of vials align as seen in FIG. 6. The hopper "H" is commercially available from Service Engineering Inc. under the serial number 24100. The first track 54, the second track 56, and the conveyor belt 52 form the conveyor means for moving the string of vials through the printing process. Via the first track 54, the array of vial strings are transported to the in-line feed assembly 55 that includes realignment means 90 for pushing a single string of vials off of the first track 54 and onto the second track 56. From the second track 56, the string of vials are deposited onto the mandrel 92, and wherein the mandrel 92 is similar in construction and purpose as mandrel 10 previously discussed.

The in-line feed assembly 55 includes a plurality of air jet nozzles 94, 96, 98, 100 for emitting an air stream and wherein air is delivered to the jet nozzles via conduit 102. Hence, the air pressure produced by the jet nozzles produces a force against the body of the array of vial strings that in turn causes the array of vials to advance along track 54. The jet nozzles will be energized intermittently, and wherein the timing and synchronizing of the air supply is by the photo-eye sensor means 104 for determining whether the vials are properly positioned at the end 105 of track 54 and before the track 56.

In normal operations, the photo-eye sensor means 104 can detect when a string of vials is in a proper position for delivery to the second track 56, and therefore, photo-eye sensor means 106 transmits a signal to controller C. The photo-eye sensor means 104 can also transmit a signal in order to halt the air stream which in turn terminates the movement of the array of vial strings if the string of vials are improperly positioned at end 105 of track 54. For instance, if one of the string of vials is not positioned properly, and the laser beam generated from A1 to B1 is broken, the photo-eye sensor means 104 signals the control means C to stop the air stream thereby halting movement of the array of vial strings. Additionally, the photo-eye sensor 104 and control means C times and synchronizes a gate G, and wherein the gate G is opened when a vial string is properly positioned to be delivered to the in-line assembly 55. Thereafter, the gate G automatically closes and restricts additional vial strings from moving forward. The gate remains closed if the photo-eye sensor 104 detects an improperly placed string of vials. The control means C then synchronizes and times the next opening of the gate G, which in turn will allow for advancement of a vial string as previously discussed.

The photo-eye sensor means 104 is commercially available from Keyence Corp. under the model number FS-V21RP. The control means C is a programmable logic controller that contains a micro-processor means that is capable of receiving input data, processing the input data, and generating an output in the form of an electrical signal to a specific component that controls the synchronizing and timing of the system, as well understood by those of ordinary skill in the art. Controller means are commercially available from Allen Bradley Inc. under the name SLC 5/05 CPU series.

As noted earlier, the in-line feed assembly 55 includes the realignment means 90, and wherein the realignment means 90 includes piston 106 that will extend outward so that an individual string of vials on the track 54 will be pushed to the second track 56, and wherein the second track 56 will then direct the vial string onto the mandrel. Piston 106 is controlled via the photo-eye sensor means 104 and control means C, as previously noted.

As seen in FIG. 6, the in-line feed assembly 55 further includes a belt transporter 110 for moving the vial strings to the mandrels. More specially, the belt transporter 110 in the most preferred embodiment comprises a first gear 112, a second gear 114, and a third gear 116, and the belt 118, which is wrapped about the three gears. The belt 118 will have notches 120*a*, 120*b*, 120*c*, 120*d*, 120*e*, and wherein the notches are spaced at a distance approximately equal to the length of the vial string. In this way, each notch will engage with an individual vial string. As the gears rotate via a motor (not seen in this view), the belt 118 will also rotate which in turn will allow for the advancement of the vial string along the track 56. From the belt transporter 110, the vial strings will drop from the second track 56 onto the mandrel 92. As noted earlier, the mandrel 92 is operatively attached to the conveyor belt 52 of the printing system.

FIG. 6 further shows the vial depressor 58. The vial depressor 58 consist of a first wheel 122 and the second wheel 124. In the most preferred embodiment, the two wheels are intergrally formed together. The two wheels are attached via shaft 126 and the bushing 128. The wheels 122, 124 will freely rotate about the shaft 126 in the preferred embodiment. In an alternate embodiment (not shown), the wheels 122, 124 are separate and can each independently rotate. As seen in FIG. 6, the shaft 126 is attached to a hydraulic cylinder 130 via the arm 132. The hydraulic cylinder will extend a piston (not shown in this figure) that will raise and lower arm 132, which in turn will raise and lower the wheels 124 and 128. The wheels 122, 124, in the most preferred embodiment, are constructed of a hard plastic.

Once the string of vials is captured on the mandrel, the conveyor belt transports the mandrel through the process of printing to the vials and curing the ink on the vials, and then removing the vials from the mandrels, as previously described. A photo-eye sensor, seen generally at 133, is down stream of the vial depressor 58, and is similar to the photo-eye sensor 104, and wherein the laser sensor 133 detects whether the string of vials is captured on the mandrels and generates a signal to the control means C in order to halt the process in the event a vial string is not seated properly on a mandrel.

Figure 7:
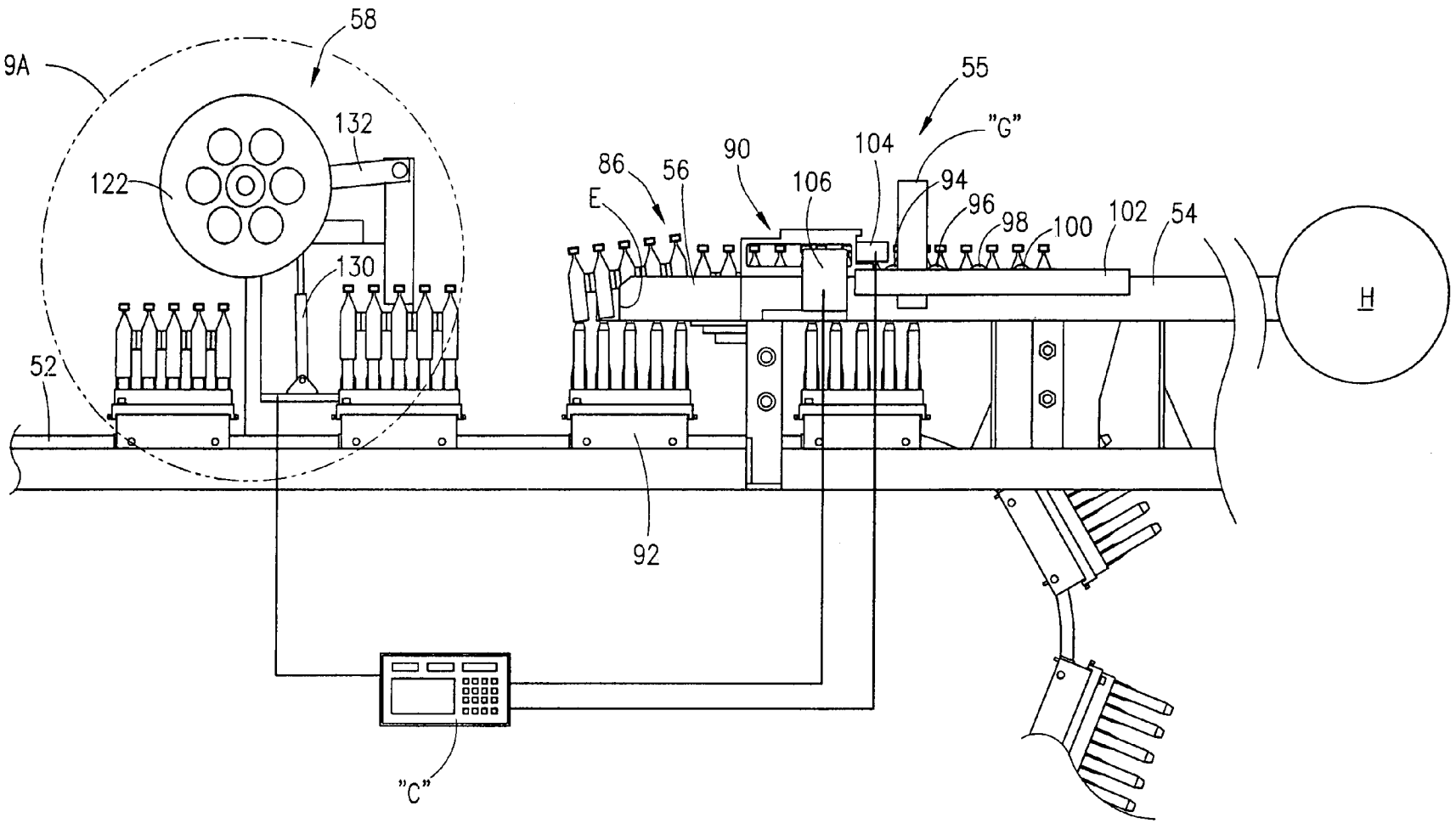
FIG. 7 is a side view of the in-line feed assembly and the vial depressor seen in FIG. 6.

As shown in FIG. 7, a side view of the in-line feed assembly 55 and the vial depressor 58 seen in FIG. 6 will now be described. FIG. 7 depicts the array of vial strings 86 positioned within the second track 56. As noted earlier, the array of vial strings 86 consist of several strings of vials, wherein the string of vials consist of five (5) interconnected vials. The string of vials fed onto the first track 54 are obtained from the hopper H. The air jet nozzles 94, 96, 98, 100 move the array of vial strings along the first track 54, and wherein the commands for energizing piston 106 and opening gate G is timed and synchronized via the photo-eye sensor means 104. The gate G opens temporarily to allow advancement of a vial string. The piston 106 re-aligns the individual string of vials to the second track 56, and wherein the in-line feed assembly 55 advances the string of vials 86 to an awaiting mandrel 92.

Figure 8A:
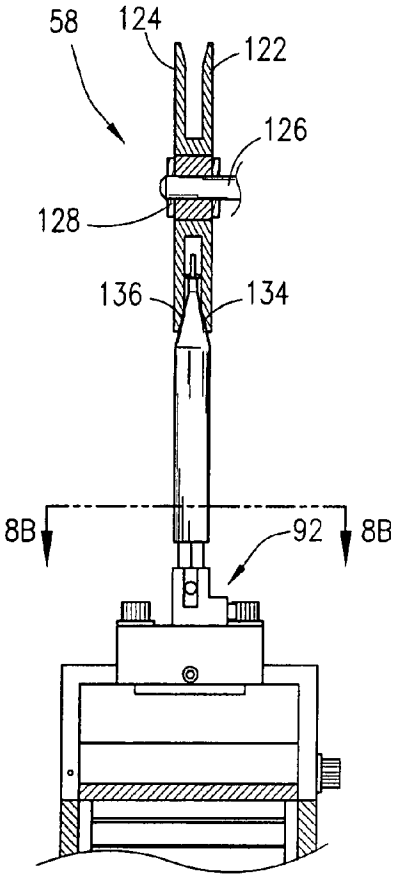
FIG. 8A is a partial front view of the vial depressor with the wheels depressing the vial string onto the mandrel.
Figure 8B:
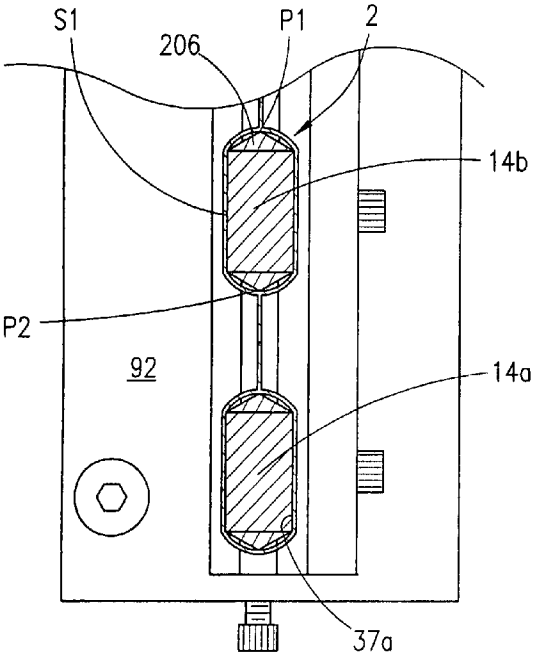
FIG. 8B is a partial cross-sectional vial of the string of vials on the mandrel taken from line I—I.

In FIG. 8A, a partial front view of the vial depressor 58 shows the wheels 122, 124 depressing the vial string onto the mandrel 92. As shown, the chamferred surfaces 134, 136 of wheels 122, 124 respectively, will abut the top portion of the string of vials thereby depressing the string of vials onto the mandrel 92. More specifically, due to the flared bottom portion of the receiving post, the vial string will fit snugly so that the vial string is captured on the mandrel. FIG. 8B is a partial cross-sectional view of the string of vials captured on the receiving post, taken from line I—I of FIG. 8A. FIG. 8B depicts the oblong area of the flared bottom portion of each receiver post abutting the inner portion 37*a* of the individual vials. FIG. 8B shows the triangular cross-sectional areas of the bottom portion 20*b* and shows how each bottom flare provides a pressure point P1 and P2 against the inner vial. Also, the receiver post side surface S1 provides a backing surface for the printing onto the vial. It should be noted that if the vial has a different shape, then the receiver post must also have a complementary shape.

Returning to FIG. 7, once the mandrel 92 is past the vial depressor 82, the wheels 122, 124 will lift via hydraulic cylinder 130 under the control of control means C. When the next mandrel is in the proper position, the vial depressor 58, and in particular the hydraulic cylinder 130 will cause the wheels 122, 124 to lower and another string of vials can be captured on the next mandrel.

As seen in FIG. 7, and in operation, the hopper "H" delivers the array of vial strings to first track 54, and wherein the air jet nozzles 94–100 push the array of vial strings to the realignment means 90. The realignment means 90 pushes a single string of vials (five interconnected vials such as seen in FIG. 1) from the first track 54 to a second track 56. The realignment means 90 is being timed with the coordination of the photo-eye sensor 104, so that if the photo-eye sensor 104 detects a string of vials, it signals the control means "C" which in turn signals the realignment means 90 to advance the string of vials to the second track 56. The opening gate G is also timed and synchronized via control means C. Once the advancement continues, the belt transporter 110 (which is seen in FIG. 6) will engage the string of vials via one of the notches (ergo 120*a*, 120*b*, 120*c*, and 120*e*) thereby advancing an individual string of vials to the end E of the track 56, and in particular, onto the receiving post of the awaiting mandrel 92. The vial depressor 58 is also timed via the control means C. Thus, the vial depressor 58 is activated when a mandrel reaches a certain position. Once the mandrel reaches a predetermined position, the vial depressor 58 travels longitudinally downward, engages the top of the vial string (as seen in FIG. 8A), so that the string of vials is captured on the receiving post of the mandrel. Once captured, the string of vials can be printed as earlier described.

Figure 9A:
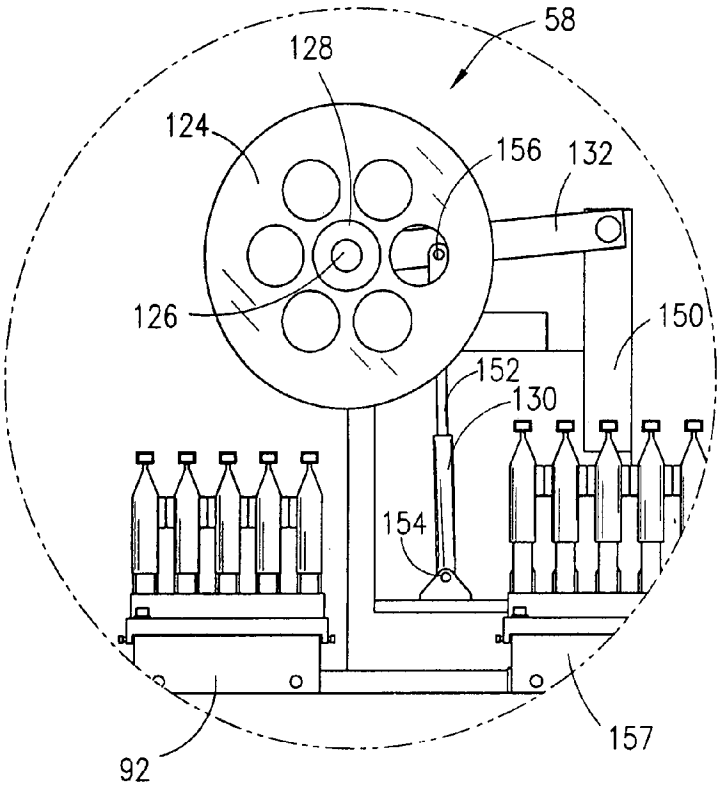
FIG. 9A is an enlarged, partial view of the vial depressor.

Referring now to FIG. 9A, an enlarged, partial view of the vial depressor 58 will now be described. FIG. 9A depicts the wheel 124 disposed about the bushing 128. The tamper arm 132 is pivotly connected at one end to the base cylinder 150, and at the opposite end to the shaft 126. FIG. 9A depicts the hydraulic cylinder 130, and wherein the hydraulic cylinder 130 contains an extendable piston 152, and wherein the piston 152 is extended on command of the control unit as previously set out. Note how the cylinder 130 is pivotly connected to the base 154. The piston 152 is connected to the arm 132 at connection point 156. Mandrel 92 has the string of vials captured thereon, while the next mandrel 157 has a string of vials that requires capturing.

Figure 9B:
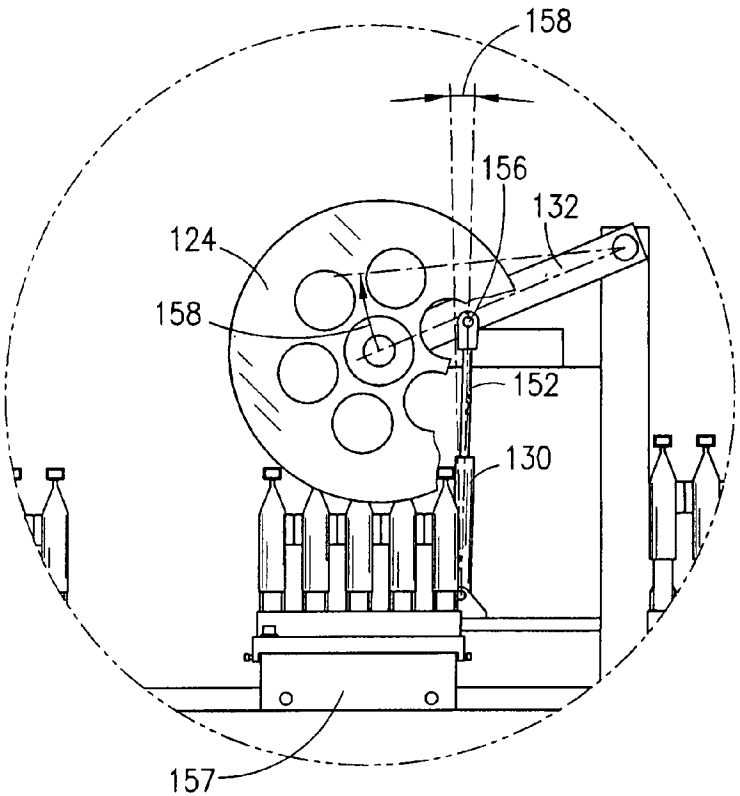
FIG. 9B is a sequential view of the vial depressor seen in FIG. 9A.

FIG. 9B is a sequential view of the vial depressor 58 seen in FIG. 9A. The piston 152 is now in the retracted position. Hence, as the piston 152 retracted, the arm 132 is pivoted lower. The wheel 124 is also lowered. The hydraulic cylinder 130 pivoted at the base 154, and the arm 132 pivoted at connection point 156. The actual movement of the wheel 124 will be in an arc, as denoted by the arrow 158 due to the multi-connections. As previously described, in the act of lowering the wheels, the vials will be captured onto the mandrel 157.

Figure 10:
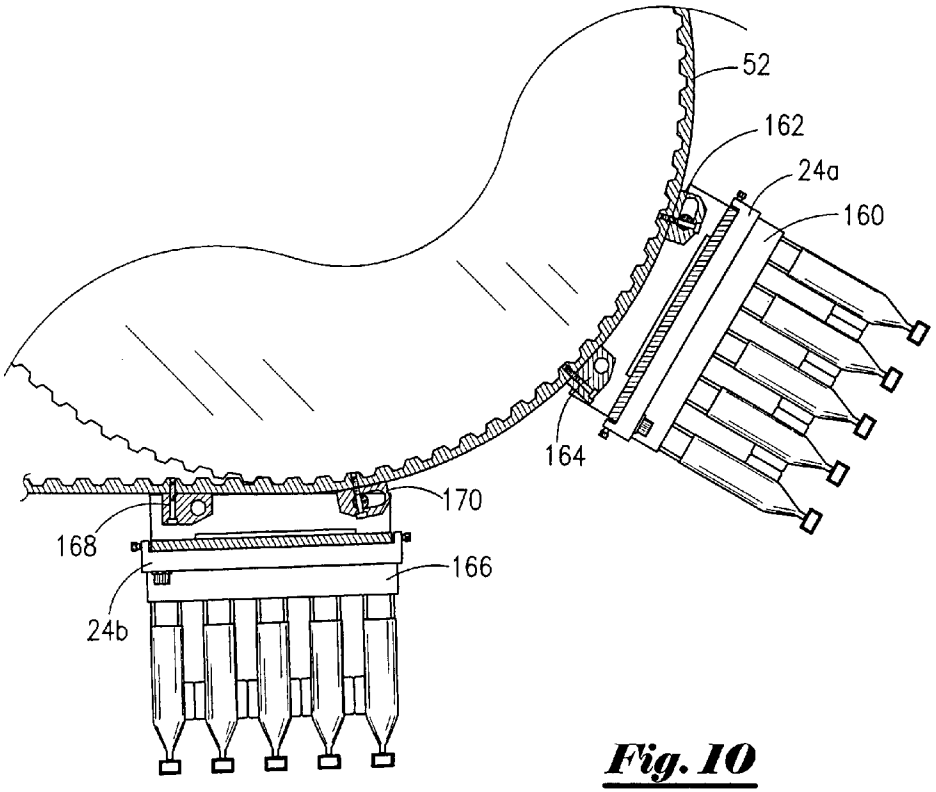
FIG. 10 is an enlarged, partial view of the conveyor belt with attached mandrels.

Referring now to FIG. 10, an enlarged, partial view of the conveyor belt 52 with attached mandrels will now be described. More specifically, FIG. 10 depicts the mandrel 160 with the drive blocks 162, 164 that are attached to the conveyor belt 52. Also shown is the mandrel 166 with the drive blocks 168, 170 that are attached to the conveyor belt 52. In this view, it is seen where the mandrels (ergo mandrels 160, 166) can be transported through a curve, or bend. By having the drive blocks individually connected to the conveyor belt 52, the drive blocks can allow for pivoting relative to the fastener sleeves 24*a*, 24*b*.

Figure 11:
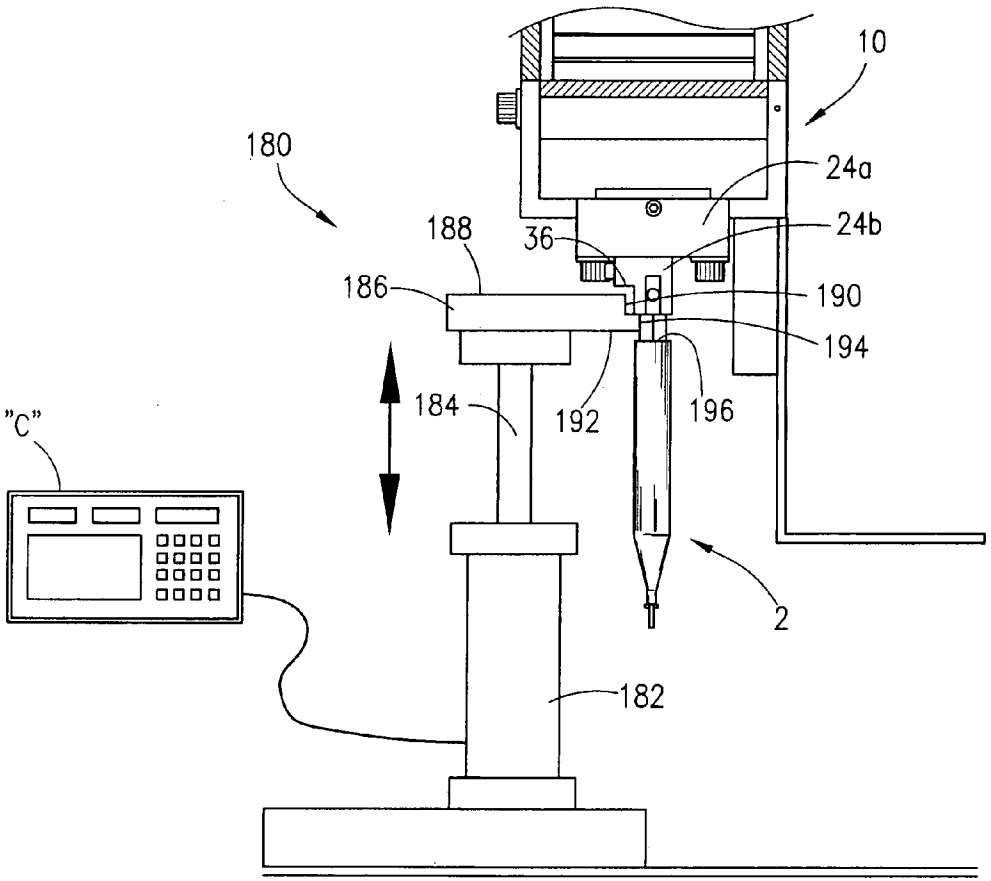
FIG. 11 is a partial cross-sectional view of the vial remover of the present invention.

FIG. 11 is a partial cross-sectional view of the vial remover 180 of the present invention. More specifically, the vial remover 180 consist of a hydraulic cylinder 182 that has an extendable piston 184, and wherein the hydraulic cylinder is connected to the control means C. The piston 184 has attached thereto the removal plate 186. The mandrel 10 is shown with the captured string of vials 2 disposed on the receiving post. The removal plate 186 has generally the cross-sectional shape of a rectangle, and wherein the upper surface 188 extends to the shoulder 190. The lower surface 192 extends to horizontal end surface 194. In the most preferred embodiment of the vial remover 180 seen in FIG. 11, the shoulder 190 is configured to fit into the complementary shoulder 36 of the rim 24*b* of fastener sleeve 24. As seen in FIG. 11, the lower surface 192 will allow the vial end 196 to travel past lower surface 192; however, once the control means C signals the cylinder 182, the piston 184 can lower and the lower surface 192 will engage the vial end 196 thereby removing the strings of vials from the receiving post. In the position seen in FIG. 11, the shoulder 190 is engaged with the complementary shoulder 36 on the rim 24*b* of fastener sleeve 24*a* of the mandrel 10.

Although this disclosure has been described and illustrated certain preferred embodiments of the invention, it is to be understood that the invention is not restricted to these particular embodiments. Rather, the invention includes all embodiments, which are functional, electrical or mechanical embodiments of the specific embodiments and features that have been described and illustrated herein.

We claim:

1. An apparatus for printing onto vials, and wherein said vials are connected in a series, the vials having an open end and a closed end, the apparatus comprising:

a conveyor belt for moving the vials, said conveyor belt having a mandrel for receiving the open end of the vials, said mandrel containing a plurality of receiving post for receiving the vials, wherein said receiving post comprise a base portion of each receiving post having an oblong cross-sectional area that has a greater cross-sectional area than a head portion of the receiving post;

a vial depressor for depressing the vials onto the receiving posts of the mandrel, wherein the vial depressor comprises: a first wheel and a second wheel, and wherein a top portion of the vials will abut a space created between the first wheel and the second wheel;

a first offset inking transfer device for printing a first ink pattern onto the vials;

a first ultra violet dryer positioned to receive the vials from the first offset inking transfer device and provide for drying of the ink pattern from the first offset inking transfer device;

a second offset inking transfer device for printing a second ink pattern onto the vials;

a second ultra violet diver positioned to receive the vials and provide for drying of the ink pattern from the second offset ink transfer device.

2. The apparatus of claim 1 further comprising:

a vial remover comprising a plate positioned on the underside of the conveyor belt and down stream of the second ultra violet dryer so that the vials are removed from the mandrel.

3. The apparatus of claim 2 further comprising an air cooler means, positioned downstream of the second ultra violent dryer, for cooling the air and directing the cool air onto the vials in order to cool the vials.

4. The apparatus of claim 3 further comprising a hopper for feeding vials onto a track;

and, a photo-eye device, positioned downstream of the hopper, for determining whether the vials are positioned on the track and transmitting a signal to a control means if the vials are improperly positioned on the track.

5. The apparatus of claim 4 further comprising a laser engraver, positioned downstream of the first ultra violet dryer, in order to engrave an alpha numeric number onto the vials.

6. The apparatus of claim 5 further comprising a flame treater means, positioned upstream of the first offset inking transfer device, for heat treating the vials in preparation of printing the ink pattern on the vial.

7. An apparatus for imprinting vials, and wherein said vials are connected in a series, the apparatus comprising:

a hopper for holding the vials and delivering the vials to a track, and wherein the vials have an open end and a closed end;

a conveyor belt for moving the vials, said conveyor having a mandrel for receiving the open end of the vials, said mandrel containing a plurality of receiving posts, for receiving the vials, and wherein said receiving posts has a head portion and a base portion, with the base portion having an oblong cross-sectional area, and wherein the base portion of each receiving post has a greater cross-sectional area than the head portion of each receiving post;

a vial depressor for depressing the vial onto the receiving post of the mandrel, wherein the vial depressor comprises: a first wheel and a second wheel, and wherein a top of the vials will abut a space created between the first wheel and the second wheel;

a first offset inking transfer device for printing a first ink pattern onto the vials;

a first ultra violet dryer positioned to receive the vials from the first offset inking transfer device and provide for curing of the ink pattern from the first offset inking transfer device.

8. The apparatus of claim 7 further comprising an air cooler device positioned downstream of said first ultra violent dryer for directing air onto the vials in order to cool the vials.

9. The apparatus of claim 8 further comprising:

a vial remover comprising a plate positioned on the underside of the conveyor belt and down stream of the first ultra violet dryer so that the vials are removed from the mandrel.

10. The apparatus of claim 9 further comprising a photo-eye device, positioned downstream of the hopper, for determining whether the vials are positioned on the track and transmitting a signal to a control means in order to halt the conveyor belt if the vials are improperly positioned on the track.

11. The apparatus of claim 10 further comprising a laser engraver in order to engrave an alpha numeric number onto the vials.

12. The apparatus of claim 11 further comprising a flame treater device, positioned upstream of the first offset inking transfer device so that the vials are heat treated in preparation of the printing of the ink pattern on the vials.

13. The apparatus of claim 12 further comprising:

a second offset inking transfer device for printing a second ink pattern onto the vials;

a second ultra violet dryer positioned to receive the vials and provide for curing of the ink pattern from the second offset ink transfer device.

14. A method of imprinting a series of interconnected vials comprising:

providing the series of interconnected vials onto a track;

placing the vials onto a mandrel having a plurality of receiving posts for receiving the vials, wherein a base portion of each receiving post has an oblong cross-sectional area that is of greater cross-sectional area than a head portion of each receiving post;

depressing the vials onto the plurality of receiving post of the mandrel with a vial depressors, wherein said vial depressor comprises: a first wheel and a second wheel, and wherein a top of the vials will abut a space created between the first wheel and the second wheel, and the step of depressing the vials includes;

abutting the first wheel and the second wheel against said top portion of the vials so that the vials are captured on the mandrel;

printing onto the vials with a first offset inking transfer device;

curing the ink with a first ultra violet dryer printing onto the vials with a second offset inking device;

curing the ink with a second ultra violet dryer;

removing the vials with a remover comprising a plate positioned down stream of the second ultra violet dryer so that the vials are removed from the mandrel.

15. The method of claim 14 further comprising:

cooling the vials.

16. An apparatus for printing onto vials, and wherein said vials are connected in a series, wherein the vials have an open end and a closed end, the apparatus comprising:

a hopper for holding the vials;

a conveyor means, operatively associated with said hopper, for moving the vials, said conveyor means having attached thereto a mandrel for receiving the open end of the vials, said mandrel containing a plurality of receiving posts for receiving the vials, wherein a base portion of each receiving post has a cross-sectional area that is of greater cross-sectional area than a cross-sectional area of a head portion of each receiving post;

a vial depressor for depressing the vial onto the receiving post of the mandrel, wherein the vial depressor comprises: a first wheel and a second wheel, and wherein a top of the vials will abut a space created between the first wheel and the second wheel;

a first offset inking transfer device for printing a first ink pattern onto the vials;

a first ultra violet dryer positioned to receive the vials from the first offset inking transfer device and provide for curing of the ink pattern from the first offset inking transfer device.

17. The apparatus of claim 16 further comprising a flame treater means, positioned downstream of the vial depressor so that the vials are heat treated in preparation of printing the ink pattern on the vials.

18. The apparatus of claim 17 further comprising an air cooler device, positioned downstream of said first ultra violet dryer, for directing air onto the vials in order to cool the vials.

19. The apparatus of claim 18 further comprising:

a vial remover comprising a plate positioned on the underside of the conveyor means and down stream of the first ultra dryer so that the vials are removed from the mandrel.

20. The apparatus of claim 19 further comprising a photo-eye device, operatively associated with said conveyor means, for determining whether the vials are positioned on the conveyor means and transmitting a signal in order to halt the conveyor means if the vials are improperly positioned on the conveyor means.

21. The apparatus of claim 19 further comprising a laser engraver, positioned downstream of said first ultra violet dryer, for engraving an alpha numeric number onto the vials.

22. The apparatus of claim 18 further comprising:

a second offset inking transfer device for printing a second ink pattern onto the vials;

a second ultra violet dryer positioned to receive the vials and provide for curing of the ink pattern from the second offset ink transfer device.

23. An apparatus for printing onto plastic containers connected in series, the containers having an open end and a closed end, the apparatus comprising:

a conveyor means for moving the containers, said conveyor means having a mandrel for receiving the containers, said mandrel containing a plurality of receiving cost for receiving the containers and wherein said receiving posts comprise a base portion having an oblong cross-sectional area and wherein the base portion of each receiving post has a greater cross-sectional area than a head portion of each receiving post;

a hopper containing said containers and delivering said series of containers to a first track;

and, an in-line feed assembly for receiving said containers and delivering said series of containers to the mandrel;

a container depressor for capturing the containers on the mandrel, said container depressor comprises: a first wheel and a second wheel, and wherein a top portion of the containers will abut a space created between the first wheel and the second wheel;

a first offset inking transfer device for printing a first ink pattern onto the containers;

a first ultra violet dryer positioned to receive the containers from the first offset inking transfer device and provide for curing of the first ink pattern from the first offset inking transfer device.

24. The apparatus of claim 23 further comprising:

a second offset inking transfer device for printing a second ink pattern onto the containers;

a second ultra violet dryer positioned to receive the containers and provide for curing of the second ink pattern from the second offset ink transfer device.

25. The apparatus of claim 24 wherein said containers are connected in a series and said mandrel contains a plurality of receiving posts for receiving the containers.

26. The apparatus of claim 25 wherein said in-line feed assembly comprises:

air jet means for advancing said containers;

realignment means for receiving said containers from said air jet means and delivering said containers to a belt transporter.

27. The apparatus of claim 26 wherein said belt transporter has a second track, and wherein said realignment means comprises:

a photo-eye sensor for determining if said containers on said first track;

piston for pushing said containers from said first track onto said second track.

28. The apparatus of claim 27 wherein said belt transporter further comprises:

a plurality of gears;

a belt disposed around said plurality of gears;

notches formed on said belt that engage said series of containers while on said second track, and delivers said containers to said mandrel.

29. An apparatus for printing to a string of vials comprising:

a conveyor means for receiving the string of vials from a track and moving the string of vials, said conveyor means having a mandrel for receiving the open end of the vials, said mandrel containing a plurality of receiving posts, for receiving the vials, wherein said receiving posts has a head portion and a base portion and wherein the base portion of each receiving post has a greater cross-sectional area than the head portion of each receiving post;

an in-line feed assembly for delivering said vials to the mandrel a wheel for engaging a top portion of the string of vials and capturing the string of vials onto the receiving post of the mandrel;

a flame treater means, positioned downstream of the wheel, for heat treating the string of vials;

an offset inking transfer device for printing a first ink pattern onto the vials; and, an ultra violet dryer positioned to receive the vials from the first offset inking transfer device and provide for drying of the ink pattern from the first offset inking transfer device.

30. The apparatus of claim 29 wherein said in-line feed assembly comprises:

air jet means for advancing said vials;

realignment means for receiving said vials from said air jet means and delivering said vials to a belt transporter.

31. The apparatus of claim 30 wherein said realignment means comprises:

a photo-eye sensor for determining if said vials are positioned on said track.

32. The apparatus of claim 31 wherein said belt transporter comprises:

a plurality of gears;

a belt disposed around said plurality of gears;

notches formed on said belt that engage said vials, and delivers said vials to said mandrel.

* * * * *